US007875413B2

(12) United States Patent
Shibai et al.

(10) Patent No.: US 7,875,413 B2
(45) Date of Patent: Jan. 25, 2011

(54) CAPSULATED TONER HAVING FINE PARTICLE CYCLOOLEFIN COPOLYMER RESIN SHELL

(75) Inventors: Yasuhiro Shibai, Yamatokoriyama (JP); Katsuru Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 884 days.

(21) Appl. No.: 11/797,143

(22) Filed: May 1, 2007

(65) Prior Publication Data

US 2007/0259284 A1 Nov. 8, 2007

(30) Foreign Application Priority Data

May 2, 2006 (JP) ..... P2006-128479

(51) Int. Cl.
*G03G 9/093* (2006.01)

(52) U.S. Cl. ..... 430/110.2

(58) Field of Classification Search ..... 430/110.2
See application file for complete search history.

(56) References Cited

U.S. PATENT DOCUMENTS

| | | | |
|---|---|---|---|
| 5,087,677 | A | 2/1992 | Brekner et al. |
| 5,331,057 | A | 7/1994 | Brekner et al. |
| 5,422,409 | A | 6/1995 | Brekner et al. |
| 5,475,060 | A | 12/1995 | Brekner et al. |
| 5,602,219 | A | 2/1997 | Aulbach et al. |
| 5,646,220 | A | 7/1997 | Brekner et al. |
| 6,790,577 | B1 | 9/2004 | Nakamura |
| 6,846,602 | B2 | 1/2005 | Suwa et al. |
| 2005/0041523 | A1 | 2/2005 | Nakano |
| 2006/0172217 | A1 | 8/2006 | Kidokoro |
| 2009/0087765 | A1 | 4/2009 | Kidokoro |

FOREIGN PATENT DOCUMENTS

| | | | | |
|---|---|---|---|---|
| CN | 1408079 | A | | 4/2003 |
| CN | 1615175 | A | | 5/2005 |
| CN | 1759350 | A | | 4/2006 |
| EP | 0 156 464 | | | 10/1985 |
| EP | 0 203 799 | | | 12/1986 |
| EP | 0 283 164 | | | 9/1988 |
| EP | 0 317 262 | | | 5/1989 |
| EP | 0 407 870 | | | 1/1991 |
| EP | 978766 | A1 | * | 2/2000 |
| JP | 05-009223 | | | 1/1993 |
| JP | 05-107808 | | | 4/1993 |
| JP | 05-181301 | | | 7/1993 |
| JP | 5-339327 | A | | 12/1993 |
| JP | 06-271628 | | | 9/1994 |
| JP | 07-253315 | | | 10/1995 |
| JP | 2000-147829 | | | 5/2000 |
| JP | 2003-114546 | | | 4/2003 |
| JP | A 2005-3945 | | | 1/2005 |
| JP | 2006276307 | A | * | 10/2006 |
| JP | A 2006-346557 | | | 12/2006 |

OTHER PUBLICATIONS

English language machine translation of JP 2006-276307 (Oct. 2006).*

* cited by examiner

*Primary Examiner*—Christopher RoDee
(74) *Attorney, Agent, or Firm*—Nixon & Vanderhye P.C.

(57) ABSTRACT

There is provided a capsulated toner which has low-temperature fixing ability, good storage stability, excellent charge stability, high fixing strength to a sheet paper, and low consumption, and is capable of forming a color image of high-definition, high-gloss, and high-density. The capsulated toner for electrophotography includes a shell layer containing a cycloolefin copolymer resin and a core particle including a synthetic resin different from the cycloolefin copolymer resin, wherein the capsulated toner has a core/shell type structure.

8 Claims, 1 Drawing Sheet

CAPSULATED TONER HAVING FINE PARTICLE CYCLOOLEFIN COPOLYMER RESIN SHELL

CROSS-REFERENCE TO RELATED APPLICATION

This application claims priority to Japanese Patent Application No. 2006-128479, which was filed on May 2, 2006, the contents of which, are incorporated herein by reference, in their entirety.

BACKGROUND OF THE INVENTION

1. Field of the Invention

The present invention relates to a capsulated toner.

2. Description of the Related Art

An electrophotographic image forming apparatus comprises components used for an image forming process mechanism, including: a photoreceptor, a charging section for charging a surface of the photoreceptor, an exposure section for irradiating the surface of the photoreceptor being charged with signal light to form thereon an electrostatic latent image corresponding to image information, a developing section for supplying a toner contained in a developer retained in a developer tank to the electrostatic latent image formed on the surface of the photoreceptor to form thereon a toner image, a transfer section provided with a transfer roller for transferring the toner image formed on the surface of the photoreceptor to a recording medium, a fixing section provided with a fixing roller for fixing the toner image onto the recording medium, and a cleaning section for cleaning the surface of the photoreceptor after the toner image has been transferred. In the electrophotographic image forming apparatus, the electrostatic latent image is developed using a one-component developer including a toner, or a two-component developer including a toner and a carrier, as a developer to form an image.

The electrophotographic image forming apparatus can form an image having fine image quality at high speeds and low costs, thereby being utilized for copying machines, printers, facsimiles and the like, along with remarkable popularization thereof in recent years. Simultaneously, requirements for the image forming apparatus have become all the more severe. For example, with the requirement of reduction of carbon-dioxide emissions for prevention of global warming, lower power consumption of the image forming apparatus has become a major issue. That is, the image forming apparatus requires a method for forming an image by fusing a toner mainly using a thermoplastic resin as a binder resin and fixing the toner to the recording medium, in which the thermoplastic resin has to be fused by heating the toner up to a temperature of around 100° C. or more. To heat the toner, a heating apparatus having a large power consumption, such as a heater, is used. In addition, the heating apparatus is set so as to continue a heating for resuming an image forming in a short time, by maintaining a temperature of the fixing section fixed even when the heating apparatus is in a ready and waiting state in which an image is not formed. Moreover, a few hundred to a few thousand of images are formed per day on one image forming apparatus. Therefore, in the image forming apparatus, power consumption required for fixing a toner is too much to ignore. Accordingly, a toner having a lower temperature (a fixing temperature) to be used for fixing the toner onto the recording medium has been achieved. As the toner having the lower fixing temperature, examples thereof include a toner using resin materials having lower glass transition temperatures, a lower softening temperature, and the like, as a binder resin, and a toner composed by dispersing a wax having a low melting point into a binder resin. However, there has been a problem in which these toners are excellent in low-temperature fixing ability onto the recording medium, but are insufficient with respect to storage stability thereof. For example, when a toner having a low melting point is retained for a long time in the developer tank, the toner is fused and attached to the photoreceptor, causing toner filming, and thus causing a defective image, or reduction of a lifetime of the photoreceptor. In addition, when the two-component developer is used, the toner filming onto a surface of a carrier also takes place, causing the defective image.

To solve the problems for the toner having a low melting point, there has been disclosed a capsulated toner achieved by a coating surface of a core particle including a colorant and a binder resin with a shell layer composed of fine resin particles (refer to Japanese Unexamined Patent Publication JP-A 5-107808 (1993) and Japanese Unexamined Patent Publication JP-A 5-181301 (1993). The capsulated toner disclosed in JP-A 5-107808 is a toner obtained by coating the surface of the core particle containing polyester with the shell layer composed of fine particles of a styrene resin and/or an acrylic resin obtained by soap-free emulsion polymerization. The capsulated toner disclosed in JP-A 5-181301 is a toner obtained by coating the surface of the core particle composed of a styrene-acrylic resin copolymer with the shell layer composed of fine particles of the styrene resin. In these patent documents, by using resin materials having comparatively lower glass transition temperatures or melting points as the binder resin contained in the core particle, and by using the fine particles composed of resins having relatively higher glass transition temperatures or melting points than those of the binder resin of the core particle as fine resin particles constituting the shell layer, the storage stability of the toner has been improved while maintaining the low-temperature fixing ability onto the recording medium. The styrene resin has an enhanced hydrophobic characteristic and a reduced moisture-absorption characteristic, providing an advantage that a change in chargeability due to moister absorption is decreased. However, the styrene resin has a high glass transition temperature of 100° C. or more, possibly decreasing the low-temperature fixing ability when used alone. The acrylic resin is advantageous in that its glass transition temperature can be adjusted by selecting a monomer. However, there has been a problem in which the chargeability thereof is changed by absorbing moisture at a high temperature and a high humidity, since molecules thereof include hydrophilic portions such as an ester bond and a hydroxyl group. Fine resin particles composed of polyester are also used other than the styrene resin and the acrylic resin, but polyester has the same problem as the acrylic resin.

Meanwhile, it has been previously proposed that a cycloolefin resin is used as a binder resin of a toner (refer to JP-A 2003-114546, for example). The cycloolefin resin has high transparency and is thus suitable for forming a color image, and has a low specific gravity and is thus capable of reduction of a toner consumption. In addition, the cycloolefin resin has no polar radical in molecules thereof and a low moisture-absorption characteristic, thus providing good charge stability. In addition, the use of the cycloolefin resin facilitates control of a glass transition temperature by selecting a kind of monomers. As described above, the cycloolefin resin has various kinds of advantages, and is thus useful as a binder resin of a toner. However, the cycloolefin resin has no polar radical in molecules thereof, and thereby has an advantage of exhibiting the good charge stability, but, on the other hand, has a problem of low adhesion to a sheet of paper.

Accordingly, an image formed by using a toner containing the cycloolefin resin as a binder resin has a low fixing level to a sheet of paper, and a low print gloss.

SUMMARY OF THE INVENTION

An object of the invention is to provide a capsulated toner which has low-temperature fixing ability, good storage stability, excellent charge stability, excellent adhesiveness to a sheet paper, and an increased maximum capability of image formation per unit quantity of the toner in comparison with a conventional toner, and is capable of forming a color image of high-definition quality and high print gloss.

The invention provides a capsulated toner, comprising:

a shell layer containing a cycloolefin copolymer resin; and a core particle containing a synthetic resin different from the cycloolefin copolymer resin, wherein the capsulated toner has a core/shell type structure.

According to the invention, in the capsulated toner including the core particle and the shell layer for coating a surface of the core particle, by using at least a cycloolefin copolymer resin as a material constituting the shell layer, and by using a synthetic resin different from the cycloolefin copolymer resin, a capsulated toner can be obtained which has low-temperature fixing ability, good storage stability, excellent charge stability, excellent adhesiveness to a sheet paper, and an increased maximum capability of image formation per unit quantity of the toner in comparison with a conventional toner, and is capable of forming a color image of high-definition quality and high print gloss. In particular, the capsulated toner of the invention has comparatively good compatibility between the cycloolefin copolymer resin and other synthetic resins included in the core particle, even though a surface of the capsulated toner is coated with the cycloolefin copolymer resin having poor fixing ability to a sheet of paper or the like. Accordingly, the cycloolefin copolymer resin and other synthetic resins are mixed at the instant when a capsulated form is broken by pressure when fixing a toner. Therefore, an area in which the cycloolefin copolymer resin directly contacts with the recording medium is reduced to strongly fix an image onto the recording medium. In addition, the cycloolefin copolymer resin is present only on a surface layer of the capsulated toner of the invention, contributing a high fixing level of an image onto the recording medium. Further, according to the invention, a fixing temperature of the capsulated toner is reduced to prevent an increase in temperature within the image forming apparatus, reducing an amount of heat loaded to the capsulated toner in a developer tank. Therefore, a charge failure by the deteriorated capsulated toner, coarse particle formation caused by mutually fusion-bonded toners, and toner filming are further reduced to stably form a high-definition image excellent in image density and resolution.

Further, in the invention, it is preferable that the synthetic resin different from the cycloolefin copolymer resin is a synthetic resin selected from polyester, polyether, polyether sulfone, a styrene-acrylic resin, an epoxy resin, and polyurethane.

Further, in the invention, it is preferable that the synthetic resin different from the cycloolefin copolymer resin is a synthetic resin selected from polyester, polyether sulfone, and a styrene-acrylic resin.

According to the invention, the synthetic resin different from the cycloolefin copolymer resin included in the core particle is preferably a synthetic resin selected from polyester, polyether, polyether sulfone, a styrene-acrylic resin, an epoxy resin, and polyurethane, and more preferably a synthetic resin selected from polyester, polyether sulfone, and a styrene-acrylic resin. The use of these synthetic resins makes the fixing level of an image formed by using the capsulated toner of the invention onto the recording medium such as a sheet of paper further higher, and is advantageous for reducing a particle diameter of the capsulated toner of the invention. Reduction of the particle diameter contributes to reduction of the toner consumption.

Further, in the invention, it is preferable that the shell layer includes fine particles of the cycloolefin copolymer resin having a particle diameter of 30 to 500 nm.

According to the invention, by containing the fine particles of the cycloolefin copolymer resin having a particle diameter of 30 to 500 nm into the shell layer, when fixing the toner, the cycloolefin copolymer resin, and the synthetic resin different from the cycloolefin copolymer resin included in the core particle is more uniformly mixed to further improve the fixing level of an image to the recording medium, and to improve the smoothness of surface of the image and the print gloss of the image.

Further, in the invention, it is preferable that the fine particles of the cycloolefin copolymer resin having a particle diameter of 30 to 500 nm are manufactured by a high-pressure homogenizer method.

According to the invention, by adopting the high-pressure homogenizer method in order to manufacture fine particles of the cycloolefin copolymer resin having a particle diameter of 30 to 500 nm, it becomes possible to obtain fine resin particles having a uniform shape, a narrow width of particle size distribution, and a tendency to be compatible with the other synthetic resins included in the core particle, so that fine resin particles suitable for forming the shell layer on a surface of the core particle can be manufactured comparatively readily and stably.

Further, in the invention, it is preferable that the high-pressure homogenizer method comprises:

a pulverizing step of directing a slurry having coarse particles of the cycloolefin copolymer resin under heat and pressure through a pressure-resistant nozzle, and thereby pulverizing the coarse particles to obtain the slurry including resin particles having a particle diameter of 1 μm or less under heat and pressure;

a cooling step of cooling the slurry obtained at the pulverizing step; and a depressurizing step of depressurizing the slurry cooled at the cooling step in a stepwise manner down to such a level that the slurry causes no bubbling.

According to the invention, as the high-pressure homogenizer method, by adopting a method comprising the pulverizing step of directing the slurry having the coarse particles of the cycloolefin copolymer resin under heat and pressure through the pressure-resistant nozzle, and thereby pulverizing the coarse particles to obtain the slurry including the resin particles having a particle diameter of 1 μm or less under heat and pressure, the cooling step of cooling the slurry obtained at the pulverizing step, and the depressurizing step of depressurizing the slurry cooled at the cooling step in a stepwise manner down to such a level that the slurry causes no bubbling, the width of the particle size distribution of the cycloolefin copolymer resin obtained becomes even narrower, thereby the shell layer having a uniform thickness is formed on a surface of the core particle, and thereby chargeability of the toner, and thus uniform adherability to an electrostatic latent image are further improved.

Further, in the invention, it is preferable that a glass transition temperature of the shell layer is 5 to 30° C. higher than that of the core particle.

According to the invention, by constituting the capsulated toner so that the glass transition temperature of the shell layer is 5 to 30° C. higher than that of the core particle, the shell layer is prevented from being peeled off from the core particle when storing the capsulated toner and forming an image, further ensuring a balance between the low-temperature fixing ability and the storage stability. Note that the shell layer and/or the core particle each may be composed of two or more synthetic resins, and may have two or more glass transition temperatures. In such a case, the highest glass transition temperature of those of the shell layer and the core particle is herein referred to as the glass transition temperature.

Further, in the invention, it is preferable that the capsulated toner is used for electrophotography.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
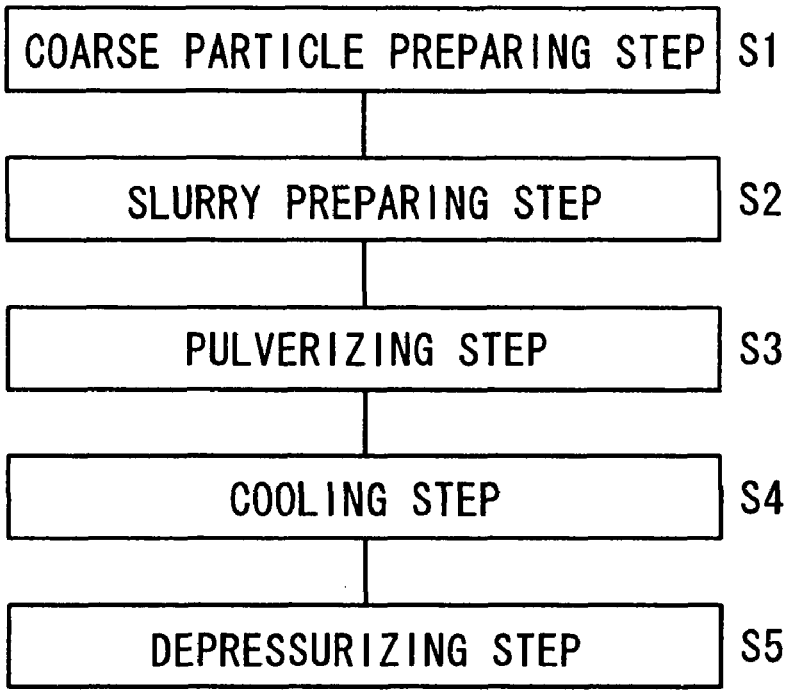
FIG. 1 is a flowchart schematically illustrating a first embodiment in a method for manufacturing fine particles of a cycloolefin copolymer resin.

Hereinafter, referring to the drawings, preferred embodiments of the invention are described in detail.

A capsulated toner of the invention is a toner having a core/shell type configuration achieved by a coating surface of a core particle with a shell layer.

The capsulated toner of the invention is preferably used for electrophotography.

[Shell Layer]

The shell layer includes a cycloolefin copolymer resin. As the cycloolefin copolymer resin, it is possible to use known ingredients, including a copolymer of acyclic olefins and cyclic olefins, and a copolymer of styrene and dicyclopentadiene, for example. The copolymer of the acyclic olefins and the cyclic olefins includes a random copolymer, a block copolymer, and the like. The acyclic olefins include lower alkene having, preferably 2 to 20 carbon atoms, and more preferably 2 to 6 carbon atoms. Specific examples of the lower alkene include α-olefins such as ethylene, propylene, 1-butene, 1-octene, 1-decene, 1-dodecene, 1-tetradecene, 1-hexadecene, 1-octadecene, and 1-eicosane. These acyclic olefins may be used alone or in combination of two or more. Specific examples of the cyclic olefins include cycloolefin having, preferably 3 to 17 carbon atoms, and more preferably 5 to 12 carbon atoms and at least one double bond. Specific examples of cycloolefin include norbornene, norbornadiene, dicyclopentadiene, dihydroxypentadiene, tetracyclo dodecene, cyclopentadiene, tetracyclopentadiene, cyclohexene, a substitution having one, or two or more substitution groups bonded to these ingredients, ether of the substitution, and ester of the substitution. Examples of the substitution group include alkyl groups such as methyl, ethyl, propyl, and butyl; alkenyl groups such as vinyl; alkylidene groups such as ethylidene; aryl groups such as pheny, tolyl, naphthyl; a cyano group; a halogen atom; an alkoxycarbonyl group; a pyridyl group; a hydroxyl group; a carboxylic acid group; an amino group; an acid anhydride group; a silyl group; an epoxy group; an acrylic group; and a methacrylic group. These cyclic olefins may be used alone or in combination of two or more.

The copolymerization of the acyclic olefins and the cyclic olefins can be implemented in accordance with known methods disclosed in, for example, Japanese Unexamined Patent Publications JP-A 5-339327 (1993), JP-A 5-9223 (1993) and JP-A 6-271628 (1994), European Unexamined Patent Publications EP-A 203799, EP-A 407870, EP-A 283164, EP-A 156464 and EP-A 317262, and Japanese Unexamined Patent Publication JP-A 7-253315 (1995). For example, the copolymerization is implemented in the presence of a catalyst used for a double bonding and releasing reaction and/or a ring-opening polymerization reaction, in an appropriate solvent. Specific examples of the catalyst include a metallocene catalyst (zirconium and hafnium may be included), a Ziegler catalyst, a metathesis polymerization catalyst. More specifically, the copolymerization reaction is implemented in the presence of the one, or two or more catalysts, at a temperature of −78 to 150° C., preferably at a temperature of 20 to 80° C. and under pressure of $1\times10^3$ to $64\times10^5$ Pa, by reacting the one, or two or more acyclic olefins with the one, or two or more cyclic olefins. Co-catalysts such as alminoxane may be added to this reaction system. A usage ratio of the acyclic olefin to the cyclic olefin is not limited to a particular level, and may be selected from a wide range as appropriate, depending on the copolymer resin to be obtained. The usage ratio is preferably 50:1 to 1:50, and more preferably 20:1 to 1:20 on a molar ratio basis. For example, when ethylene is used as the acyclic olefins, and norbornene is used as the cyclic olefins, a glass transition temperature (Tg) of the cycloolefin copolymer resin obtained is changed depending on the usage ratio of these ingredients. When a usage of norbornene is increased, the Tg has a tendency to increase. For example, when the usage of norbornene is around 60% by weight of a total amount of the usage of ethylene and the usage of norbornene, the Tg is around 60 to 70° C. Furthermore, physical properties, such as a number average molecular weight, a softening temperature, a melting point, viscosity, a dielectric characteristic, a non-offset temperature range, transparency, a molecular weight, and a molecular weight distribution, can be adjusted to desired values by selecting a type and usage ratio of the acyclic olefins and the cyclic olefins as appropriate.

In addition, when the metallocene catalyst is used, inactive hydrocarbon such as aliphatic hydrocarbon and aromatic hydrocarbon is preferable as a reaction catalyst. When the metallocene catalyst is dissolved into, for example, toluene, the metallocene catalyst is preliminary activated and thus the copolymerization reaction is smoothly progressed. The molecular weight of the cycloolefin copolymer resin obtained according to the above-described procedure is not limited to a particular level, but is preferably 10,000 to 200,000, and more preferably 20,000 to 100,000, and especially preferably, 25,000 to 50,000, based on the number average molecular weight in polystyrene equivalent, measured by a GPC (gel permeation chromatography) method using a toluene solvent. In addition, a glass transition temperature of the cycloolefin copolymer resin is not limited to a particular level, but is preferably 60 to 100° C., and more preferably 70 to 80° C., in view of obtaining the capsulated toner having good low-temperature fixing ability. When the glass transition temperature is set to a range of 60 to 100° C., the melting point is 120 to 160° C., providing sufficient durability. The glass transition temperature is a value measured at a temperature-increasing rate of 10° C./min by using a differential scanning calorimeter (trade name: DSC210, manufactured by Seiko Instruments Inc.). Note that by selecting the glass transition temperature of the cycloolefin copolymer resin as appropriate, a glass transition temperature of the shell layer can be set to a desired value.

The cycloolefin copolymer resin is preferably used in a fine particle form. Particle diameters of the fine particles are not limited to a particular level, but are preferably 30 to 500 nm, and more preferably 30 to 250 nm. By using the fine particles having the above-described particle diameter range, the shell layer having a uniform thickness can be formed on a surface of the core particle, and the cycloolefin copolymer resin included in the shell layer and a synthetic resin included in the core particle have a tendency to be mixed when fixing a toner. The fine particles of the cycloolefin copolymer resin may be manufactured in accordance with known methods, and is preferably manufactured by a high-pressure homogenizer method in order to obtain the fine particles having uniform shapes and a narrow particle size distribution. In accordance with the high-pressure homogenizer method, it is possible to obtain the fine particles having a uniform shape, a particle diameter in nanometers, and a narrow particle size distribution.

The high-pressure homogenizer method is herein a method for obtaining fine particles or coarse particles of the synthetic resin or the like by using a high-pressure homogenizer, and the high-pressure homogenizer is herein an apparatus for pulverizing particles under pressure. As the high-pressure homogenizer, it is possible to use commercially available products or those disclosed in patent documents or the like. Examples of the high-pressure homogenizers commercially available include chamber type high-pressure homogenizers such as MICROFLUIDIZER (trade name, manufactured by Microfluidics Co., Ltd.), NANOMIZER (trade name, manufactured by Nanomizer Co., Ltd.), ULTIMIZER (trade name, manufactured by Sugino Machine Ltd.), HIGH-PRESSURE HOMOGENIZER (trade name, manufactured by Rannie Co., Ltd.), HIGH-PRESSURE HOMOGENIZER (trade name, manufactured by Sanmaru Machinery Co., Ltd.), and HIGH-PRESSURE HOMOGENIZER (trade name, manufactured by Izumi Food Machinery Co., Ltd.). In addition, examples of the high-pressure homogenizers disclosed in patents documents include the high-pressure homogenizers disclosed in WO03/059497. Among these machines preferable is the high-pressure homogenizer disclosed in WO03/059497.

FIG. 1 shows one example of a method for manufacturing resin particles using the high-pressure homogenizer. FIG. 1 is a flowchart schematically illustrating a method for manufacturing the resin particles. The manufacturing method shown in FIG. 1 includes a coarse particle preparing step S1, a slurry preparing step S2, a pulverizing step S3, a cooling step S4, and a depressurizing step S5. Among these steps, the high-pressure homogenizer method using the high-pressure homogenizer disclosed in WO03/059497 includes the pulverizing step S3, the cooling step S4, and the depressurizing step S5. Hereinafter, a method for manufacturing the resin particles as shown in FIG. 1 will be specifically described.

[Coarse Particle Preparing Step S1]

At the coarse particle preparing step S1, the cycloolefin copolymer resin is coarsely pulverized to obtain coarse particles. For example, the cycloolefin copolymer resin is melt-kneaded, and a resultant melt-kneaded material is cooled, and then a resultant cooled solidified material is pulverized to obtain the coarse particles of the cycloolefin copolymer resin. The melt-kneaded material of the cycloolefin copolymer resin can be manufactured, for example, by melt-kneading the cycloolefin copolymer resin while heating the cycloolefin copolymer resin up to a temperature no less than a fusing temperature thereof. For melt-kneading, it is possible to use typical kneading machines including a twin screw extruder, a three-roll machine, and LABO-PLASTMILL. More specific examples thereof include single or twin screw extruders such as TEM-100B (trade name, manufactured by Toshiba Machine Co., Ltd.), PCM-65/87 (trade name, manufactured by Ikegai Ltd.); and open-roll type kneaders such as KNEADEX (trade name, manufactured by Mitsui Mining Co., Ltd.). The resulting melt-kneaded material is cooled to obtain the solidified material. The cooled solidified material is coarsely pulverized by using particle pulverizing machines such as a cutter mill, a feather mill, and a jet mill to obtain the coarse particles of the cycloolefin copolymer resin. Particle diameters of the coarse particles are not limited to a particular level, but are preferably 450 to 1,000 μm, more preferably around 500 to 800 μm.

[Slurry Preparing Step S2]

At the slurry preparing step S2, the coarse particles of the cycloolefin copolymer resin (hereinafter, unless otherwise noted, referred to as merely "coarse particles") obtained at the coarse particle preparing step S1 are mixed with liquid, and dispersed into the liquid to prepare a coarse particle slurry. There is no limitation to the liquid mixed with the coarse particles, as long as the liquid is a fluid substance that can uniformly disperse the coarse particles without solving the coarse particles. In view of easiness of process control, liquid waste disposal after completion of all steps, and the like, the liquid is preferably water, more preferably water containing a dispersion stabilizer. The dispersion stabilizer is preferably added to water before adding the coarse particles to water. As the dispersion stabilizer, the selection of ingredients is not particularly limited, but the dispersion stabilizer commonly used in this field can be used. Among such dispersion stabilizers, preferable is a water-soluble polymeric dispersion stabilizer.

Examples of the water-soluble polymeric dispersion stabilizer include: (meth)acrylic polymers, polyoxyethylene polymers, cellulose polymers, polyoxyalkylene alkylarylether sulfate salts, polyoxyalkylene alkylether sulfate salts. The (meth)acrylic polymers contain one or two hydrophilic monomers selected from: acrylic monomers such as (meth) acrylic acid, α-cyanoacrylate, α-cyanomethacrylate, itaconic acid, crotonic acid, fumaric acid, maleic acid, and maleic acid anhydride; hydroxyl-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester monomers such as diethylene glycol monoacrylic ester, diethylene glycol monomethacrylic ester, glycerine monoacrylic ester, and glycerine monomethacrylic ester; vinyl alcohol monomers such as N-methylol acrylamide and N-methylol methacrylamide; vinylalkylether monomers such as vinylmethylether, vinylethylether, and vinylpropylether; vinylalkylester monomers such as vinyl acetate, vinyl propionate, and vinyl butyrate; aromatic vinyl monomers such as styrene, α-methylstyrene, and vinyl toluene; amide monomers such as acrylamide, methacrylamide, diacetone acrylamide, and methylol compounds thereof; nitrile monomers such as acrylonitrile and methacrylonitorile; acid chloride monomers such as chloride acrylate and chloride methacrylate; vinyl nitrogen-containing heterocyclic monomers such as vinylpyridine, vinylpyrrolidone, vinylimidazole, and ethyleneimine; and cross-linking monomers such as ethyleneglycol dimethacrylate, diethyleneglycol dimethacrylate, allyl methacrylate, and divinylbenzene. Examples of polyoxyethylene polymers include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester. Examples of cellulose polymers include methylcellulose, hydroxyethylcellulose, and hydroxypropylcellulose. Examples of polyoxyalkylene alkylarylether sulfate salts include sodium polyoxyethylene laurylphenylether sulfate, potassium polyoxyethylene laurylphenylether sulfate, sodium polyoxyethylene nonylphenylether sulfate, sodium polyoxyethylene oleylphenylether sulfate, sodium polyoxyethylene cetylphenylether sulfate, ammonium polyoxyethylene laurylphenylether sulfate, ammonium polyoxyethylene nonylphenylether sulfate, and ammonium polyoxyethylene oleylphenylether sulfate. Examples of polyoxyalkylene alkylether sulfate salts include sodium polyoxyethylene laurylether sulfate, potassium polyoxyethylene laurylether sulfate, sodium polyoxyethylene oleylether sulfate, sodium polyoxyethylene cetylether sulfate, ammonium polyoxyethylene laurylether sulfate, and ammonium polyoxyethylene oleylether sulfate. These dispersion stabilizers can be used alone or in combination of two or more. A usage of the dispersion stabilizer is not limited to a particular level, but is preferably 0.05% to 10% by weight, more preferably 0.1% to 3% by weight, based on a total amount of water and the dispersion stabilizer.

The coarse particles of the cycloolefin copolymer resin and the liquid are mixed by using typical blending machines to obtain the coarse particle slurry. Here, an amount of the coarse particles to be added to the liquid is not limited to a particular level, but is preferably 3% to 45% by weight, more preferably 5% to 30% by weight, based on a total amount of the coarse particles and the liquid. In addition, the coarse particles and the liquid may be mixed under a pressurized or cooled condition, but are generally mixed at a room temperature. Examples of the blending machine include, Henschel type blending machines such as HENSCHEL MIXER (trade name, manufactured by Mitsui Mining Co., Ltd.), SUPER MIXER (trade name, manufactured by KAWATA MFG. Co., Ltd.), and MECHANOMILL (trade name, manufactured by Okada Seiko, Co., Ltd.); ANGMILL (trade name, manufactured by Hosokawa Micron KK); HYBRIDIZATION SYSTEM (trade name, manufactured by Nara Machinery Co., Ltd.); and COSMO SYSTEM (trade name, manufactured by Kawasaki Heavy Industries, Ltd.). The resultant coarse particle slurry may be directly applied to the pulverizing step S3, but may be treated, for example, with a typical coarse pulverization procedure as a preliminary treatment to coarsely pulverize into the coarse particles having a particle diameter of, preferably around 100 μm, and more preferably 100 μm or less. The coarse pulverization treatment is performed, for example, by directing the coarse particle slurry through a nozzle under high pressure.

[Pulverizing Step S3]

At the pulverizing step S3, the coarse particle slurry obtained at the slurry preparing step S2 is directed under heat and pressure through a pressure-resistant nozzle. The coarse particles are thus pulverized into fine resin particles to obtain the slurry containing the fine resin particles. A pressurizing and heating condition for the coarse particle slurry is not limited to a particular condition. The coarse particle slurry is preferably pressurized to 50 to 250 MPa and heated to 50° C. or more, and more preferably pressurized to 50 to 250 MPa and heated to 90° C. or more, and especially preferably pressurized to 50 to 250 MPa and heated to a temperature in a range of 90° C. to (Tm+25)° C. (Tm: a half softening temperature of the cycloolefin copolymer resin, measured by a flow tester, ° C.). When the pressure is less than 50 MPa, shear energy may be possibly decreased to prevent sufficient reduction of a particle diameter. When the pressure is more than 250 MPa, an actual production line is exposed to excessively increased risk, which is found to be unrealistic. The coarse particle slurry is directed into the pressure-resistant nozzle through the inlet thereof under pressure and heat in the above-described range.

Figure 2:
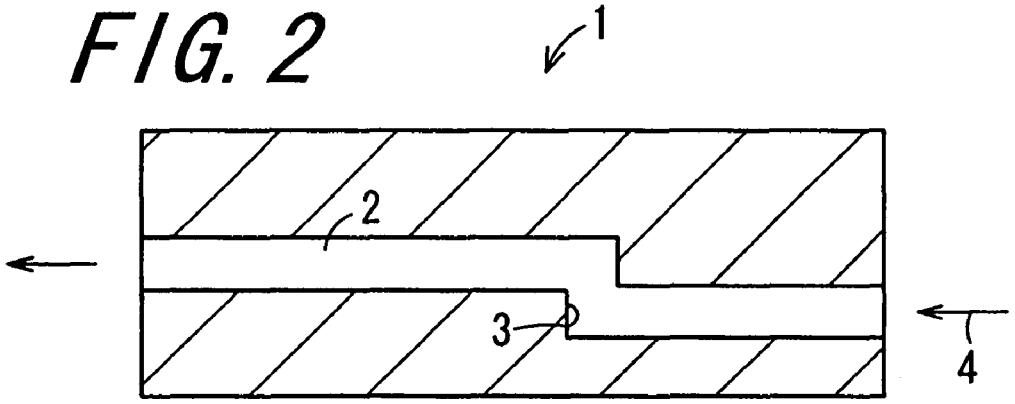
FIG. 2 is a cross-section view schematically illustrating a configuration of a pressure-resistant nozzle.

As the pressure-resistant nozzle, it is possible to use a typical pressure-resistant nozzle capable of flowing fluid. For example, a multiple nozzle having two or more liquid flowing passages can be preferably used. The liquid flowing passage of the multiple nozzle may be concentrically arranged centering around an axis line of the multiple nozzle, or the two or more liquid flowing passages may be arranged approximately parallel to one another in a longitudinal direction of the multiple nozzle. One example of the multiple nozzle includes a nozzle provided with one or more, preferably one or two liquid flowing passages having inlet diameters and outlet diameters of around 0.05 to 0.35 mm and a length of 0.5 to 5 cm. In addition, the pressure-resistant nozzle includes the nozzle shown in FIG. 2. FIG. 2 is a cross-section view schematically illustrating a configuration of a pressure-resistant nozzle 1. The pressure-resistant nozzle 1 includes a liquid flowing passage 2 therein, and the liquid flowing passage 2 is bent in a form of a hook, and includes at least one collision wall 3, against which the coarse particle slurry flowing into the liquid flowing passage in a direction of an arrow 4 collides. The coarse particle slurry collides against the collision wall 3 at an approximately right angle and thereby the coarse particles are pulverized to produce the fine resin particles having further reduced diameters, and the resultant fine resin particles are discharged from the pressure-resistant nozzle 1. In the pressure-resistant nozzle 1, the inlet is formed so as to have a diameter identical to that of the outlet. The embodiment is not limited to such a manner, and the outlet may be formed to have a diameter shorter than that of the inlet. These pressure-resistant nozzles may be provided alone or in combination. The slurry discharged from the outlet of the pressure-resistant nozzle includes, for example, the fine resin particles having diameters reduced to around 30 to 500 nm, is heated to a range of 60 to Tm+60° C. (Tm is the same as above-mentioned, ° C.), and is pressurized to around 10 to 50 MPa.

[Cooling Step S4]

At the cooling step S4, the slurry containing the fine resin particles having reduced diameters under heat and pressure, obtained at the pulverizing step S3, is cooled. At the cooling step S4, the slurry discharged from the pressure-resistant nozzle at the previous step, is cooled. There is no limitation to a cooling temperature. However, to give one indication, for example, the pressure applied to the slurry is reduced to around 5 to 80 MPa when the slurry is cooled to a temperature of 30° C. or less. Any typical fluid cooling machine having a pressure-resistant structure can be used for cooling, and among such cooling machines preferable is a cooling machine having a wide cooling area, such as a corrugated tube type cooling machine. In addition, it is preferable that the cooling machine is configured so that a cooling gradient is increased from an inlet of the cooling machine to an outlet thereof (or cooling capability therefrom/thereto is decreased). Accordingly, diameters of the fine resin particles are even more efficiently reduced. Further, coarse particle formation caused by mutual reattachment of the fine resin particles is prevented, allowing an increase in yield of the fine resin particles having reduced diameters. For example, the slurry containing the fine resin particles having reduced diameters, which is discharged from the pressure-resistant nozzle at the previous step, is directed from the inlet of the cooling machine into the cooling machine, cooled within the cooling machine having the cooling gradient, and is discharged from the outlet of the cooling machine. The cooling machines may be disposed alone or in combination.

[Depressurizing Step S5]

At the depressurizing step S5, the slurry containing the fine resin particles under pressure, which is obtained at the cooling step S4, is depressurized down to such a level that the slurry causes no bubbling. The slurry introduced from the cooling step S4 to the depressurizing step S5 remains pressurized to around 5 to 80 MPa. It is preferable that the slurry is gradually depressurized in a stepwise manner. A multistage depressurizing apparatus disclosed in WO03/059497 is preferably used for this depressurizing operation. The slurry containing the fine resin particles under pressure, which is obtained at the cooling step S4, is introduced from the cooling step S4 to the depressing step S5, and then introduced into the multistage depressurizing apparatus, for example, by disposing a pressure-resistant pipe between a section where the cooling step S4 is performed and a section where the depressurizing step S5 is performed, and disposing a supply pump and a supply valve on the pressure-resistant pipe. The multistage depressurizing apparatus is configured so as to include an inlet passage for directing the slurry containing the fine resin particles under pressure into the multistage depressurizing apparatus, an outlet passage arranged to communicate with the inlet passage, for discharging the slurry containing the fine resin particles depressurized to an outside of the multistage depressurizing apparatus, and a multistage depressurizing section disposed between the inlet passage and the outlet passage and configured by coupling two or more depressurizing members on each other via a linking member.

Examples of the depressurizing member used for the multistage depressurizing section in the multistage depressurizing apparatus include a pipe-shaped member. Examples of the coupling member include a ring-shaped seal. The multistage depressurizing apparatus is configured by coupling the two or more pipe-shaped members having various inner diameters on each other using the ring-shaped seal. For example, from the inlet passage toward the outlet passage, two to four pipe-shaped members having common diameters are coupled on each other, and on these pipe-shaped members is then one pipe-shaped member having a inner diameter about twice larger than that of these pipe-shaped members coupled, and on these pipe-shaped members are further one to three pipe-shaped members having inner diameters around 5% to 20% smaller than that of the one pipe-shaped member further coupled. As a result, the slurry containing the fine resin particles flowing through the pipe-shaped members is gradually depressurized and finally depressurized down to such a level that the slurry causes no bubbling, preferably to the atmospheric pressure. A heat exchange section employing a cooling medium and a heating medium may be disposed around the multistage depressurizing section to cool or heat in accordance with a pressure value applied to the slurry containing the resin particles. The one multistage depressurizing apparatus, or the two or more multistage depressurizing apparatuses may be disposed. The slurry containing the fine resin particles, depressurized in the multistage depressurizing apparatus, is discharged from the outlet passage to an outside of the multistage depressurization apparatus.

Accordingly, the slurry containing the fine resin particles having reduced diameters of around 30 to 500 nm is obtained. This slurry can be directly used for manufacturing the capsulated toner as described later. In addition, the fine resin particles having reduced diameters, which are isolated from the slurry, may be used as a new slurry. To isolate the fine resin particles from the slurry, typical isolation apparatuses such as filtration and centrifugal separation are employed. In the above-described procedures, the steps of S1 to S5 may be implemented only once, or thereafter the steps of S3 to S5 may be repeated.

[Core Particle]

The core particle may contain a binder resin and a colorant, and further contain a release agent, a charge control agent, and the like. As the binder resin, any ingredients conventionally used as a toner binder resin may be used as long as the ingredients have a comparatively good compatibility with the cycloolefin copolymer resin, and good fixing ability to the recording medium at a low temperature. Specific examples thereof include, thermoplastic resins such as polyester, polyether, polyether sulfone, polystyrene, polyacrylic acid ester, a styrene-acrylic resin, a styrene-methacrylic acid resin, polyvinyl chloride, polyvinyl acetate, and polyvinylidene chloride; and thermohardening resins such as a phenol resin, an epoxy resin, and polyurethane. Among these resins, preferable are polyester, polyether, polyether sulfone, a styrene-acrylic resin, an epoxy resin, and polyurethane, and especially preferable are polyester, polyether sulfone, a styrene-acrylic resin. These binder resins may be used alone or in combination.

As the colorant, it is possible to use an organic pigment, an inorganic dye, and an inorganic pigments, which are commonly used in the electrophotographic field. Examples of a black colorant include carbon black, copper oxide, manganese dioxide, aniline black, activated carbon, non-magnetic ferrite, magnetic ferrite, and magnetite.

Examples of a yellow colorant include yellow lead, zinc yellow, cadmium yellow, yellow iron oxide, mineral fast yellow, nickel titanium yellow, navel yellow, naphtol yellow-S, hanza yellow-G, hanza-yellow 10G, benzidine yellow-G, benzidine yellow-GR, quinoline yellow lake, permanent yellow-NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Examples of an orange colorant include red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Examples of a red colorant include red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of a purple colorant include manganese purple, fast violet B, and methyl violet lake.

Examples of a blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of a green colorant include chromium green, chromium oxide, pigment green B, malachite green lake, final yellow green G, and C.I. pigment green 7.

Examples of a white colorant include compounds such as zinc white, titanium oxide, antimony white, and zinc sulfide.

These colorants may be used alone, or two or more of the colorants of different colors may be used in combination. Further, two or more of the colorants with the same color may be used in combination. A usage of the colorant is not limited to a particular level, but is preferably 0.1 to 20 parts by weight, and more preferably 0.2 to 10 parts by weight, based on 100 parts by weight of the binder resin.

As the release agent, it is possible to use ingredients which are commonly used in this field, including: petroleum waxes such as a paraffin wax, a derivative thereof, a microcrystalline wax, and a derivative thereof; hydrocarbon synthesis waxes such as a Fischer-Tropsch wax, a derivative thereof, a polyolefin wax (a polyethylene wax, a polypropylene wax, etc.), a derivative thereof, a low-molecular polypropylene wax, a derivative thereof, polyolefin copolymer wax (low-molecular polyethylene wax etc.), and a derivative thereof; plant-derived waxes such as a carnauba wax, a derivative thereof, a rice wax, a derivative thereof, a candelilla wax, a derivative thereof, and a wood wax; animal-derived wax such as a bee wax and a whale wax; oil and fat synthesis waxes such as fatty acid amide and phenol fatty acid ester; long-chain carboxylic acid and a derivative thereof; long-chain alcohol and a derivative thereof; silicone copolymer; and higher fatty acid. Note that the derivative includes an oxide, a block copolymer of a vinylic monomer and a wax, and a graft denatured product of a vinylic monomer and a wax. A usage of the wax is not limited to a particular level and may be selected as appropriate from a wide range. The usage of the wax is preferably 0.2 to 20 parts by weigh, more preferably 0.5 to 10 parts by weight, and especially preferably 1.0 to 8.0 parts by weight, based on 100 parts by weight of the binder resin.

As the charge control agent, it is possible to use agents for controlling positive charges and agents for controlling negative charges, which are commonly used in this field. Examples of the charge control agent for controlling positive charges include, a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. Examples of the charge control agent for controlling negative charges include, oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a fatty acid soap, long-chain alkylcarboxylic acid salt, and a resin acid soap. These charge control agents may be used each alone and according to need, two or more of the agents may be used in combination. A usage of the charge control agent is not limited to a particular level and may be selected as appropriate from a wide range. A preferable usage of the charge control agent is 0.5 to 3 parts by weight based on 100 parts by weight of the binder resin.

The core particle can be manufactured in accordance with a typical method for manufacturing a toner. Examples of the typical method for manufacturing a toner include, dry methods such as a pulverization method; and wet methods such as a suspension polymerization method, an emulsifying flocculation method, a dispersion polymerization method, and a dissolution suspension method. In the pulverization method, the binder resin, the colorant, the release agent, the charge control agent and other additive agents are mixed by the blending machines such as HENSCHEL MIXER, SUPER MIXER, MECHANOMILL, and Q-TYPE MIXER, and a resultant mixture material is melt-kneaded by the kneading machines such as a twin screw kneader, a single screw kneader, and a continuous two-roll kneader, and a resultant kneaded material is cooled and solidified, and a solidified material is pulverized by a air pulverizing machine such as a jet mill, and treated with a size control method such as classification as needed, to produce the core particle. In addition, in the emulsifying flocculation method, binder resin particles are emulsified and dispersed into water, and a water dispersion of the binder resin particles has the colorant, fine particles of the release agent and the charge control agent as needed, dispersed, and the water dispersion has a flocculating agent added to produce flocculated particles in which the binder resin particles, the colorant, and the like are flocculated, and the resultant flocculated particles are heated, to produce the core particle. Among these kinds of manufacturing methods, preferable are the emulsifying flocculation method, the dissolution suspension method, and the like, due to a wide selection range of resins. A particle diameter of the core particle is not limited to a particular level, but are preferably 3 to 8 μm, more preferably 4 to 6 μm, in volume-average particle diameter, in view of coating the shell layer, and the like. Here, the volume-average particle diameter is measured, using a Coulter counter TA-III (trade name, manufactured by Coulter Electronics Inc.), under a condition of an aperture diameter: 100 μm, a particle diameter to be measured: 2 to 40 μm on a number basis, and a measured particle number: 50,000 counts. In addition, a glass transition temperature of the core particle is preferably 40 to 70° C., more preferably 50 to 60° C. Further, the glass transition temperature of the core particle is preferably set so as to be 5 to 30° C. lower than the glass transition temperature of the shell layer. When the difference is less than 5° C., the obvious difference of a fusing characteristic between the core particle and the shell layer may be possibly disappeared, resulting that a balance between the low-temperature fixing ability and the storage stability with respect to the capsulated toner of the invention may become insufficient. In addition, when the difference exceeds 30° C., it becomes difficult to enhance adherability between the core particle and the shell layer by fusing both of them on an interface therebetween. Accordingly, the shell layer has a tendency to be peeled off from the core particle, decreasing the durability of the capsulated toner. Note that it is possible to adjust the glass transition temperature of the core particle to a desired value by as appropriate selecting a type and usage of the binder resin, and the release agent when used.

[Capsulated Toner]

The capsulated toner of the invention can be manufactured by coating the core particle with the cycloolefin copolymer resin to form the shell layer. The core particle is coated with the cycloolefin copolymer resin in accordance with known methods such as a mechanofusion method, a fluid bed coating method, and a wet coating method. In the mechanofusion method, for example, a surface of the core particle have fine particles of the cycloolefin copolymer resin electrostatically-attracted, and heated and pressurized by a mechanical impact, and a portion or a total amount of the fine particles of the cycloolefin copolymer resin is fused to form a film of the shell layer. Accordingly, the capsulated toner of the invention is manufactured. In order to conduct the mechanofusion method, various kinds of commercially available mechanofusion apparatuses can be used.

Moreover, in the fluid bed coating method, a fluid bed of the core particles is formed, and sprayed with a solution of the cycloolefin copolymer resin or a dispersion of fine particles of the cycloolefin copolymer resin, to produce the capsulated toner of the invention. In order to conduct the fluid bed coating method, for example, a fluid bed coating apparatus can be used.

In addition, examples of the wet coating method include a spray dry method, a dipping method, and a fluid bed method. In the spray dry method, a surface of the core particle is sprayed and coated with a solution of the cycloolefin copolymer resin, and a solvent contained in the solution is dried to form the shell layer. Accordingly, the capsulated toner of the invention is manufactured. In the fluid bed method, the core particles are raised up by a rising pressurized gas flow to reach equilibrium, and then repeatedly sprayed and coated with the solution of the cycloolefin copolymer resin while the core particles are falling down, to form the shell layer. Accordingly, the capsulated toner of the invention is manufactured. In order to conduct the wet coating method, for example, there can be used spray coating apparatuses such as COATMIZER JET COATING SYSTEM (trade name, manufactured by Freund Industrial Co., Ltd.), spray dry apparatuses such as GRANULEX (trade name, manufactured by Freund Industrial Co., Ltd.), spray coaching apparatuses such as DISPERCOAT (trade name, manufactured by Nisshin Engineering Inc.), and a spray dryer. In addition, a water dispersion containing the core particle, the cycloolefin copolymer resin particles, the dispersion stabilizer as described above, and an appropriate amount of the surface-active agent (preferably an anion surface-active agent) has a magnesium sulfate solution, or the like added (preferably by drops) while agitating, to obtain the capsulated toner of the invention having the core particle having surfaces coated with the cycloolefin copolymer resin particles. The capsulated toner can be readily isolated from a reaction system by typical isolation purification methods such as filtration, a pure-water cleaning, a vacuum drying.

A content ratio of the shell layer of the capsulated toner of the invention is not limited to a particular level, but is preferably 5 to 30% by weight, more preferably 10 to 20% by weight, based on a total amount of the capsulated toner, in view of a balance between the low-temperature fixing ability and the storage stability with respect to the capsulated toner, a fixing level to the recording medium, and the like. When the content ratio is less than 5% by weight, the core particle may be insufficiently coated with the shell layer, decreasing the charge stability and the storage stability of the capsulated toner. On the other hand, when the content ratio exceeds 30% by weight, an amount of the cycloolefin copolymer resin as a principal component of the shell layer may possibly become too much, decreasing the low-temperature fixing ability, and the fixing level of a toner image composed of the capsulated toner onto the recording medium.

The capsulated toner of the invention is adjusted so as to be preferably 4 to 10 μm, more preferably 5 to 7 μm, in volume-average diameter. It is possible to adjust a particle diameter of the capsulated toner by as appropriate selecting a particle diameter of the core particle, and a coating amount of the shell layer. The capsulated toner of the invention may have a non-offset temperature range of 130 to 190° C., and a fixing temperature of 150 to 160° C., for example. Typical conventional toners have the non-offset temperature range of 150 to 210° C., and fixing temperatures of around 170° C. Therefore, the capsulated toner of the invention has the fixing temperature of around 10 to 20° C. lower than those of the typical conventional toners.

The capsulated toner of the invention may be treated with a surface modification using the additive agent. As the additive agent, known ingredients may be used, including silica, and titanic oxide, each surface-treated with silica, titanic oxide, a silicone resin, and a silane coupling agent. Further, a usage of the additive agent is preferably 1 to 10 parts by weight based on 100 parts by weight of the toner.

The toner of the invention can be used as a one-component developer and also as a two-component developer. When the toner is used as the one-component developer, the toner, which is used alone without using a carrier, is charged by friction with a blade and a fur brush on a developing sleeve, thereby attracted onto the developing sleeve, and thereby conveyed, to form an image. When the toner is used as the tow-component developer, the capsulated toner of the invention is used with the carrier. As the carrier, known ingredients may be used including: for example, single ferrite or composite ferrite composed of iron, copper, zinc, nickel, cobalt, manganese, and chromium; and a carrier core particle having a surface coated with a coating substance. As the coating substance, known ingredients may be used including: for example, polytetrafluoroethylene, monochlorotrifluoroethylene polymer, polyvinylidene fluoride, a silicone resin, a polyester resin, metal compounds composed of di-tert-butylphenol, a styrene resin, an acrylic resin, polyacid, polyvinyllal, nigrosine, an aminoacrylic resin, a basic dye, lake of a basic dye, silica fine particles, and alumina fine particles. The coating substances as described above are preferably selected in accordance with toner components. In addition, these coating substances may be used alone or in combination of two or more. An average particle diameter of the carrier is preferably 10 to 100 μm, more preferably 20 to 50 μm.

EXAMPLES

Hereinafter, referring to examples and comparative examples, the invention is specifically described. Hereinafter, "%" and "parts" represent "% by weight" and "parts by weight" respectively.

Example 1

[Manufacturing Example of Core Particle]

A polyester resin (a binder resin, a weight-average molecular weight: 15,000, Mw/Mn=12, a glass transition temperature of 57° C., a softening temperature of 110° C.) of 100 parts obtained by copolymerizing bisphenol A propylene oxide, a terephthalic acid, and trimellitic anhydride, 5.0 parts of copper phthalocyanine (a colorant), 5.0 parts of a paraffin wax (a release agent, a softening temperature of 78° C.), and 2.0 parts of a zinc compound of a salicylic acid (a charge control agent, trade name: BONTRON E84, manufactured by Orient Chemical Industries, Ltd.), were uniformly mixed using SUPER MIXER to obtain a mixture. The mixture was then melt-kneaded by a two-axis extruder (trade name: PCM-30, manufactured by Ikegai Co., Ltd.) with a cylinder setting temperature of 145° C., a barrel rotation number of 300 rpm, and cooled to prepare a solidified material of a melt-kneaded material. The solidified material was coarsely pulverized using a cutting mill, and then finely pulverized using an ultrasonic jet mill, and then classified by a classifier set to remove fine particles having diameters of 5 μm or less, to produce core particles. The core particles obtained had a volume-average particle diameter of 6.9 μm, and a variation coefficient of 25.

[Manufacturing Example of Cycloolefin Copolymer Resin]

The cycloolefin copolymer resin (a weight-average molecular weight: 24,000, Mw/Mn=18, a glass transition temperature of 68° C., a softening temperature of 128° C.) of 100 parts was coarsely pulverized using a cutter mill (trade name: VM-16, manufactured by Orient Corp.) to prepare coarse particles having diameters of 500 to 800 μm. The coarse particles of 100 parts were mixed with a water solution obtained by dissolving 1 part of a polymer disperser (trade name: JONCRYL 51, manufactured by Johnson Polymer Corp.), and 1 part of sodium dodecylbenzenesulfonate into 490 parts of deionized water, to prepare a water-based slurry containing the coarse particles. The water-based slurry was directed through a nozzle having an inner diameter of 0.3 mm under pressure of 168 MPa, as a preliminary treatment, to adjust a particle diameter of the coarse particles of the water-based slurry to 100 μm or less.

The water-based slurry containing the coarse particles obtained as described above was pressurized at 210 MPa and heated to 110° C. inside a pressure-resistant airtight container, and then supplied from a pressure-resistant pipe mounted on the pressure-resistant airtight container to a pressure-resistant nozzle mounted on an outlet of the pressure-resistant pipe. The pressure-resistant nozzle is a pressure-resistant multiple nozzle having a length of 0.5 cm, which is configured so that two liquid flowing holes having hole diameters of 0.143 mm are approximately parallel to each other in a longitudinal direction of the nozzle. At an inlet of the nozzle, a temperature of the water-based slurry was 115° C. and a pressure imparted to the water-based slurry was 210 MPa. At an outlet of the nozzle, a temperature of the water-based slurry was 125° C. and a pressure imparted to the water-based slurry was 42 MPa. The water-based slurry discharged from the pressure-resistant nozzle was directed into a corrugated tube-type cooling machine connected to the outlet of the pressure-resistant nozzle, and cooled. At an outlet of the cooling machine, a temperature of the water-based slurry was 30° C. and a pressure imparted to the water-based slurry was 35 MPa. The water-based slurry discharged from the outlet of the cooling machine was directed into the multistage depressurization apparatus connected to the outlet of the cooling machine and then depressurized therein. The multistage depressurization apparatus is configured by coupling five pipe-shaped members having different diameters on each other using a ring-shaped seal. The five pipe-shaped members had inner diameters, each changed from 0.5 to 1 mm in a stepwise manner. The water-based slurry discharged from the multistage depressurization apparatus contained fine particles having a particle diameter of 45 to 155 nm.

Manufacturing of Capsulated Toner

The core particles of 100 parts and the cycloolefin fine particles of 10 parts are mixed with a water solution obtained by dissolving 1 part of sodium dodecylbenzenesulfonate into 500 parts of deionized water to prepare a water-based slurry. When under agitation of 2,000 rpm by a homogenizer, 0.1% by weight of a magnesium sulfate solution was added drop by drop into the water-based slurry and then a resulting mixture was agitated for an hour, a flocculate of the cycloolefin fine particles was observed on surfaces of mother particles of a toner. The water-based slurry containing the toner flocculate was agitated for two hours at a temperature of 76° C. to form the toner particles having a uniformed particle diameter and uniformed shape in the water-based slurry. The toner particles isolated from the slurry by filtration were cleaned 3 times with a pure water (0.5 μS/cm), and thereafter dried by a vacuum drier to produce the capsulated toner having a volume-average particle diameter of 7.2 μm, and the variation coefficient of 24. Note that pure water was prepared from tap water using an ultrapure water production system (trade name: ULTRA PURE WATER SYSTEM CPW-102, manufactured by ADVANTEC Co., Ltd.). Electrical conductivity of water is measured using a LACOM TESTER (trade name: EC-PH-CON 10, manufactured by Iuchi Seieido Co., Ltd.). The obtained toner of 100 parts was mixed with 1.5 parts of silica fine particles (trade name: RX-200, manufactured by Nippon Aerosil Co., Ltd.) having surfaces coated with the silane coupling agent, by using Henschel Mixer, to produce the capsulated toner of the invention subjected to an external additive treatment.

Comparative Example 1

The core particles of 100 parts obtained in Example 1 were mixed with 1.5 parts of the silica fine particles (trade name: RX-200, manufactured by Nippon Aerosil Co., Ltd.) by using Henschel Mixer to produce a toner for comparison.

The toners obtained in Example 1 and Comparative Example 1 were applied to the following evaluation test. The results are shown in Table 1.

(1) Low-Temperature Fixing Ability and Fixing Level

The toners obtained in Example 1 and Comparative Example 1 were put into a developer tank of a developing device of a testing image forming apparatus, and then a toner amount attached to a sheet designed for full color: PP106A4C (trade name, manufactured by Sharp Kabushiki Kaisha, hereinafter, referred to as merely a "recording sheet") was adjusted to 0.5 mg/cm$^2$, to thereby form an unfixed test image including a solid image part. As the testing image forming apparatus, there was used a commercially available image forming apparatus (trade name: AR-C 150 digital full color multifunction printer, manufactured by Sharp Kabushiki Kaisha), of which the fixing device was removed as a result of remodeling of a developing device into a device for non-magnetic one-component developer. The unfixed image formed was fixed by an external fixing machine having a processing speed of 122 mm/sec, and a resultant image was used as an evaluation image. As the external fixing machine, there was used an oil-less fixing device which was taken out from a commercially available image forming apparatus (trade name: AR-C 160 digital full color multifunction printer, manufactured by Sharp Kabushiki Kaisha). The image was fixed while changing the fixing temperature in increments of 5° C. in a range of 120 to 200° C. Here, the oil-less fixing device means a fixing device that performs fixing without applying a release agent onto a heating roller.

In a Japan Society for Promotion of Science type fastness testing machine, a surface of the evaluation image was scratched back and forth three times by a sand eraser on which a load of 1 kg was placed, and optical reflection density (image density) before and after the scratching was measured by a reflection density meter (manufactured by Machbeth Co., Ltd.) to calculate a fixing ratio (%) according to the following expression. The fixing temperature was obtained when the fixing ratio exceeds 70%. The image was then evaluated according to the following criteria.

$$\text{Fixing Ratio (\%)}=[(\text{Image Density after Scratching})/(\text{Image Density before Scratching})]\times 100$$

Good: Less than 155° C. The low-temperature fixing ability is excellent, and the fixing level of the image is high.

Fair: 155° C. or more and less than 170° C. Low-temperature fixing is possible, and the fixing level of the image is within a practical range.

Bad: 170° C. or more. The low-temperature fixing is impossible.

(2) Hot-Offset Property

According to the same procedures as the low-temperature fixing ability and fixing level test described in (1), a toner image was transferred onto a recording sheet, and fixed by the external fixing machine. A blank recording sheet was then passed through the external fixing machine to observe whether the recording sheet had a toner contamination. This operation was repeated while increasing a setting temperature (the fixing temperature) of the external fixing machine in a stepwise manner. The minimum setting temperature at which the toner contamination was found was taken as a hot-offset generation temperature. The toner image was evaluated according to the following criteria.

Good: 210° C. or more. A hot-offset property is excellent.

Fair: 190° C. or more and less than 210° C. The hot-offset property is good.

Bad: Less than 190° C. The hot-offset property is insufficient.

(3) Blocking Resistance

A toner of 10 gram was put into a glass bottle of 100 ml, and the bottle was left untouched for two days in a temperature-controlled bath having a temperature of 50° C. therein. The toner was then evaluated according to the following criteria.

Good: No blocking (a fusion-bonded toner) is found.

Fair: A soft caking state in which the toners are mutually adhered with weak adhesive force is found.

Bad: A hard caking state in which the toners are mutually adhered with strong adhesive force is found.

(4) Plate Life Property

A plate life test was conducted at a temperature of 30° C., and a humidity of 80%. The image was then evaluated based on a degree of deterioration of the image.

Good: The image was not changed after the plate life test using 50,000 sheets. The chageability of the toner was not changed at a high humidity.

Fair: The image was deteriorated after the plate life test using 30,000 sheets. The chageability of the toner was slightly changed at a high humidity, deteriorating the image.

Bad: The image was significantly deteriorated after the plate life test using 5,000 sheets. The chargeability was significantly changed at a high humidity, deteriorating the image after a small number of sheets were printed.

TABLE 1

| Test Items | Example 1 | Comparative Example 1 |
|---|---|---|
| Fixing Level | Good | Good |
| Hot-offset Property | Good | Good |
| Blocking Resistance | Good | Bad |
| Plate Life Property | Good | Fair |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and a range of equivalency of the claims are therefore intended to be embraced therein.

What is claimed is:

1. A capsulated toner, comprising:

a shell layer containing a fine particle cycloolefin copolymer resin; and a core particle containing a synthetic resin different from the fine particle cycloolefin copolymer resin, wherein the capsulated toner has a core/shell type structure.

2. The capsulated toner of claim 1, wherein the synthetic resin different from the cycloolefin copolymer resin is a synthetic resin selected from polyester, polyether, polyether sulfone, a styrene-acrylic resin, an epoxy resin, and polyurethane.

3. The capsulated toner of claim 1, wherein the synthetic resin different from the cycloolefin copolymer resin is a synthetic resin selected from polyester, polyether sulfone, and a styrene-acrylic resin.

4. The capsulated toner of claim 1, wherein the shell layer includes fine particles of the cycloolefin copolymer resin having a particle diameter of 30 to 500 nm.

5. The capsulated toner of claim 4, wherein the fine particles of the cycloolefin copolymer resin having a particle diameter of 30 to 500 nm are manufactured by a high-pressure homogenizer method.

6. The capsulated toner of claim 5, wherein the high-pressure homogenizer method comprises:

a pulverizing step of directing a slurry having coarse particles of the cycloolefin copolymer resin under heat and pressure through a pressure-resistant nozzle, and thereby pulverizing the coarse particles to obtain the slurry including resin particles having a particle diameter of 1 μm or less under heat and pressure;

a cooling step of cooling the slurry obtained at the pulverizing step; and a depressurizing step of depressurizing the slurry cooled at the cooling step in a stepwise manner down to such a level that the slurry causes no bubbling.

7. The capsulated toner of claim 1, wherein a glass transition temperature of the shell layer is 5 to 30° C. higher than that of the core particle.

8. The capsulated toner of claim 1, wherein the capsulated toner is used for electrophotography, a volume-average diameter of particles of the microcapsule toner is 4 to 10 μm.

* * * * *